United States Patent [19]

Brown

[11] Patent Number: 4,852,526

[45] Date of Patent: Aug. 1, 1989

[54] DELIVERY OF FUEL IN INTERNAL COMBUSTION ENGINES

[76] Inventor: Stephen E. Brown, Rte. 10, Box 4, Mountain Home, Ark. 72653

[21] Appl. No.: 232,144

[22] Filed: Aug. 15, 1988

[51] Int. Cl.[4] ..... F02M 61/14

[52] U.S. Cl. ..... 123/52 MC; 123/470

[58] Field of Search ..... 123/470, 471, 472, 590, 123/52 M, 52 MB, 52 MC, 188 M; 261/78.1, 76, DIG. 75

[56] References Cited

U.S. PATENT DOCUMENTS

| | | | |
|---|---|---|---|
| 1,810,917 | 6/1931 | Kreis | 123/52 M |
| 2,201,014 | 5/1940 | Scheerer | 123/52 M |
| 4,029,063 | 6/1977 | Tanaka et al. | 123/52 M |
| 4,094,276 | 6/1978 | Nakamura et al. | 123/52 M |
| 4,290,405 | 9/1981 | Tipton | 123/590 |
| 4,354,470 | 10/1982 | Miyaki et al. | 123/472 |
| 4,429,667 | 2/1984 | Kawamura | 123/470 |

*Primary Examiner*—David A. Okonsky

*Attorney, Agent, or Firm*—Kokjer, Kircher, Bradley, Wharton, Bowman & Johnson

[57] ABSTRACT

The combustion efficiency of an internal combustion engine is improved by providing reservoirs in the plenum floor of the intake manifold to collect liquid fuel which precipitates out of the air-fuel mixture. A venturi is mounted in each manifold conduit and is connected with the reservoir by passages which lead to a port in the downstream, low pressure end of the venturi. The air-fuel mixture flowing toward the engine cylinders passes through the venturis and draws the liquid fuel into the flow stream, causing it to atomized into fine droplets that burn more completely in the combustion chambers. A modified form of the invention uses a venturi to receive and effect atomization of liquid fuel from a fuel injector, thus allowing the fuel injector to utilize a relatively large injector port which is less susceptible to clogging than the hair sized ports of conventional fuel injectors.

13 Claims, 2 Drawing Sheets

DELIVERY OF FUEL IN INTERNAL COMBUSTION ENGINES

BACKGROUND OF THE INVENTION

This invention relates generally to the fuel delivery systems of engines and more particularly to a method and apparatus for delivering fuel in a manner to achieve more complete combustion.

It has long been known that liquid fuel precipitates out of the air-fuel mixture in the intake manifold of a conventional internal combustion engine. The fuel liquification often occurs under the carburetor on the plenum floor near the junctions of the manifold conduits with the plenum, and this is caused primarily by the change of direction that occurs at these locations. Liquification also occurs at the dividers between the manifold conduits and at any places where there are turns or other disruptions of the flow.

The liquid fuel is eventually sucked into the cylinders where it is burned along with the fuel that remains in suspension. However, the atomized fuel that is suspended in the air-fuel mixture burns much more quickly and completely than the liquified fuel because its atomized state increases its dispersion and the area to volume ratio of the fuel droplets. The liquified fuel burns incompletely and creates numerous problems, including increased exhaust emissions, decreased engine power, reduced fuel economy, noisy operation, engine knock, fouling of the cylinders, cold starting problems and overall performance fall off.

The existence of the fuel precipitation phenomenon and the problems it causes have long been recognized. For example, U.S. Pat. No. 1,810,917 to Kreis teaches an arrangement in which the liquified fuel is collected in a trap in the intake manifold and is directed in liquid form through a passage leading to the engine cylinder. Although this removes the liquified fuel from the fuel intake system, it does little if anything to improve the combustion efficiency. The fuel is supplied in liquid form to the cylinders rather than as finely atomized droplets dispersed in the air, and the liquified fuel is burned incompletely to cause many if not all the problems previously noted. U.S. Pat. No. 2,201,014 to Scheerer discloses a similar arrangement except that the fuel from the traps is circulated back to the suction side of a charging blower rather than directed to the cylinders.

Particularly in recent years, fuel injectors have achieved considerable popularity. Although the use of fuel injectors generally eliminates the fuel precipitation problem that is associate with carburetor systems, the fuel injectors have problems of their own. Perhaps most notably, the injector must have an extremely small injector port in order to assure that the injected fuel is finely atomized so that efficient combustion takes place. However, the hair sized ports that are required are so small that they are highly susceptible to clogging by small particles of dirt or other foreign materials that are inevitably present in the fuel from time to time. Consequently, the injector ports frequently become clogged and must be cleaned or replaced before the engine can operate efficiently.

SUMMARY OF THE INVENTION

The present invention makes use of a venturi to solve the fuel precipitation problem in carburetor equipped engines and to eliminate injector clogging in fuel injected engines and diesel engines. In accordance with one form of the invention, the intake manifold of a conventional internal combustion engine is provided on the floor of its plenum with a plurality of reservoirs which are strategically located to capture liquid fuel that is present in the manifold. A venturi is mounted in each flow path between the carburetor and the intake valves of the cylinders, and each reservoir is connected with one of the venturis by a passage that opens into the downstream or low pressure side of the venturi. The air-fuel mixture which flows through the venturi creates suction in the downstream side of the venturi and thus draws the liquid fuel from the reservoir and through the passage into the venturi. The liquid fuel is atomized into fine droplets in the venturi, and the droplets are entrained by and dispersed in the air-fuel mixture as it approaches the intake valve.

Because the liquid fuel is atomized in the venturi and is carried into the cylinders in finely atomized form, it is more easily vaporized in the combustion chamber and is burned more completely. The more complete combustion of the fuel improves the fuel economy, power output and cold starting capabilities of the engine, and it also results in quieter operation, suppression of engine knock and a decrease in the exhaust emissions.

In another form of the invention which is used in fuel injected engines, each fuel injector is equipped with a venturi which is mounted in the flow path through which air moves from the intake manifold toward the intake valves. The fuel injector output port connects through a mounting stem for the venturi with the downstream or low pressure side of the venturi. Consequently, the fuel is injected into the low pressure side of the venturi and is finely atomized and entrained in the airstream passing through the venturi. Again, this fine atomization of the fuel causes combustion to take place more completely and leads to the many benefits associated with increased combustion efficiency.

It is virtually the unanimous opinion of those skilled in the design of internal combustion engines that the flow paths of fuel and air toward the cylinders should be left unobstructed in order to avoid flow disruptions which can interfere with the efficient delivery of fuel and air to the combustion chambers. Thus, the provision of a venturi in each of these flow paths in accordance with the present invention is contrary to the conventional wisdom and would be expected to cause problems in the fuel delivery system. Instead, however, the arrangement of the present invention not only avoids disruptions in the fuel delivery but also creates numerous unexpected benefits, including improved fuel economy, enhanced power, better cold starting ability, quieter engine operation, suppression of engine knock, cooler engine temperatures and reduced exhaust emissions.

DETAILED DESCRIPTION OF THE INVENTION

In the accompanying drawings which form a part of the specification and are to be read in conjunction therewith and in which like reference numerals are used to indicate like parts in the various views.

Figure 1:
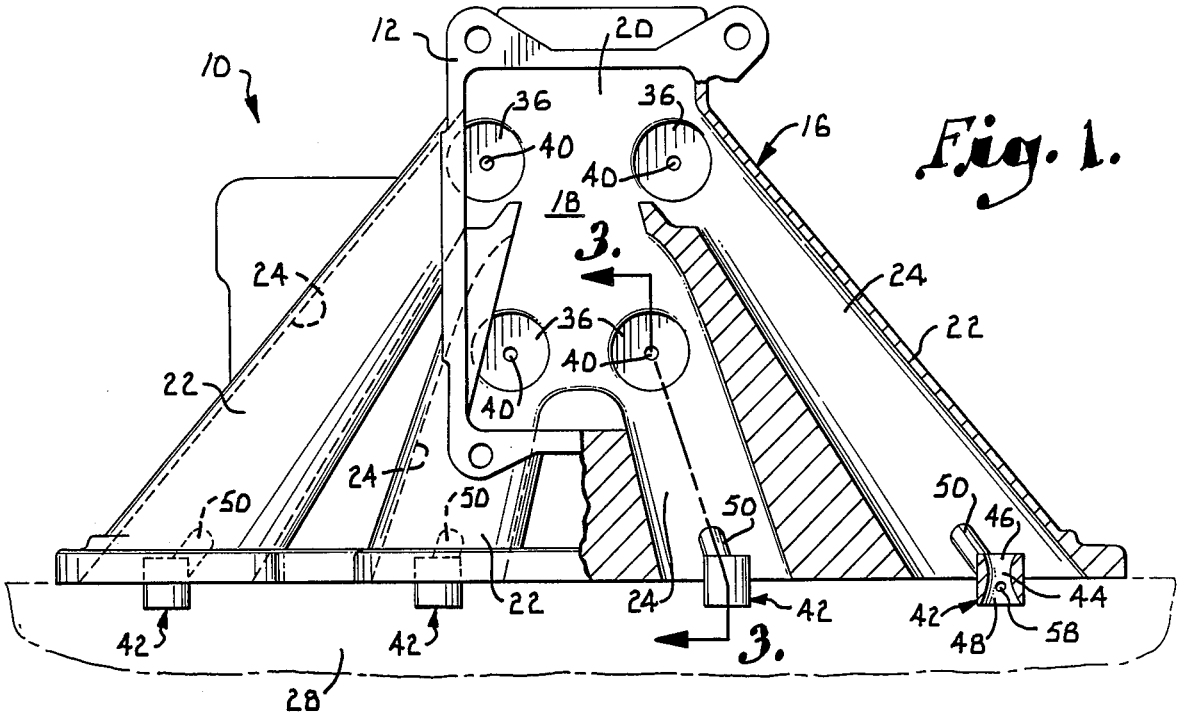
FIG. 1 is a top plan view of an intake manifold constructed according to one embodiment of the present invention, with portions broken away and shown in section for purposes of illustration.
Figure 2:
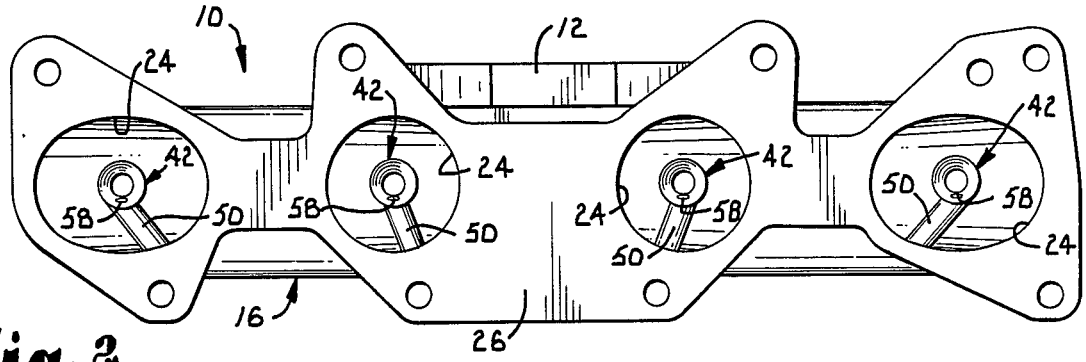
FIG. 2 is an end elevational view of the intake manifold shown in FIG. 1.
Figure 3:
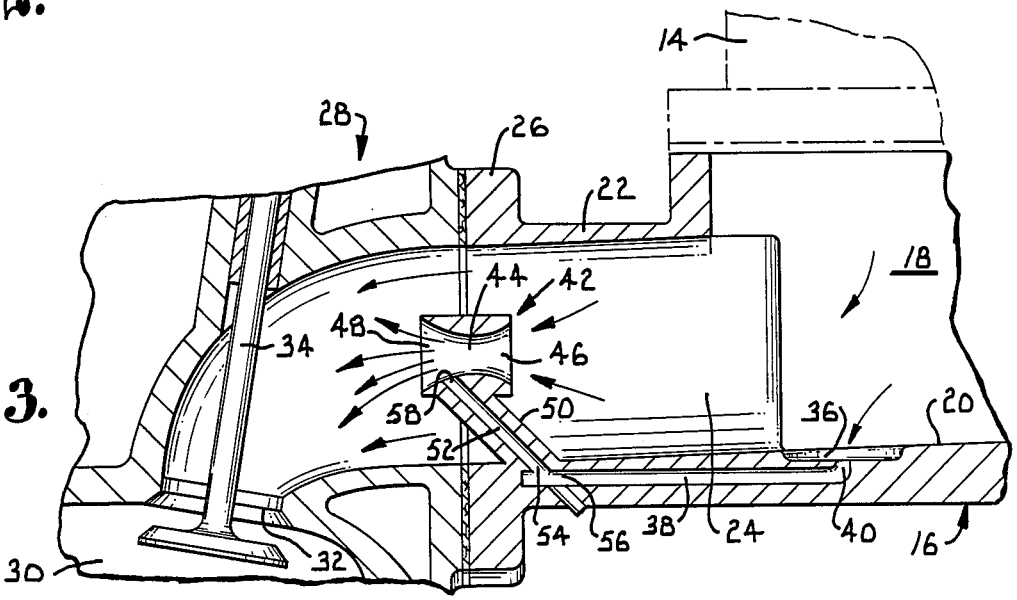
FIG. 3 is a fragmentary sectional view on an enlarged scale taken generally along line 3—3 of FIG. 1 in the direction of the arrows.

Referring now to the drawings in more detail and initially to FIGS. 1–3, numeral 10 generally designates an intake manifold which is equipped with an improved fuel delivery arrangement in accordance with the present invention. The intake manifold 10 is constructed in a conventional manner for the most part and is shown as the type of manifold used with a four cylinder, in line engine. However, it is to be understood that the improvement provided by the present invention can be used in an engine having any number of cylinders.

The intake manifold 10 has a carburetor mounting flange 12 at the top on which a carburetor 14 (see FIG. 3) may be mounted. The intake manifold 10 has a manifold body 16 which presents a plenum 18. As best shown in FIG. 3, a substantially flat floor surface 20 is provided below the plenum 18 on the manifold body 16.

The manifold body 16 includes four manifold runners or conduits 22 which all connect with and extend away from the common plenum 18. Each of the conduits 22 provides a different flow path 24 leading away from the plenum 18 to conduct the air-fuel mixture from the carburetor 14 toward the combustion chambers of the engine.

The manifold body 16 presents a manifold flange 26 located on the terminal ends of the conduits 22. The flange 26 may be mounted to a cylinder head 28 of the engine which presents four cylinders 30 each having an intake port 32. Each of the flow paths 24 leads to one of the intake ports 32. An intake valve 34 for each engine controls the intake port 32 in the usual manner.

In accordance with the present invention, the plenum floor 20 is provided with a plurality of reservoirs 36 which are formed as depressions or wells in the surface of the floor 20. Preferably, there are four reservoirs 36 formed in the plenum floor, and they are located adjacent to the intersections between the plenum 18 and the four flow paths 24, as best shown in FIG. 1. The reservoirs 36 are preferably round, although they may have other configurations.

As best shown in FIG. 3, each reservoir 36 connects with a passageway 38 which is formed in the manifold body 16 and extends generally parallel to the corresponding flow path 24. Each passageway 38 has an inlet end 40 which connects with the corresponding reservoir 36, preferably at or near its center.

A venturi 42 is mounted in each flow path 24 at its discharge or downstream end, preferably near the center of the flow path. Each venturi 42 has a restricted throat 44 near its center and an inlet side 46 which is located upstream from the throat 44. The upstream side 46 is larger in diameter than the throat 44 and tapers as it approaches the throat. The inlet or upstream side 46 is the high pressure side of the venturi. Each venturi 42 also has an outlet side 48 located downstream from the throat 44. The outlet side 48 is flared as it extends away from the throat 44 and is the low pressure side of the venturi.

Each of the venturis 42 is mounted on a mounting stem 50 which extends from the manifold body 16 at a location near the downstream end of the corresponding manifold conduit 22. Each stem 50 preferably inclines upwardly as it extends in a downstream direction. Each stem 50 has a hollow longitudinal passage 52 having an inlet end 54 connecting with the outlet end 56 of the corresponding passageway 38. The opposite or outlet end of each passage 52 terminates in a port 58 that opens into the corresponding venturi 42 in the low pressure side 48 at a location downstream from the throat 44.

In operation of the engine, the air-fuel mixture supplied by the carburetor 14 flows into the plenum 18 and into and through each of the manifold flow passages 24. Some part of the fuel which is carried in suspension in the air-fuel mixture precipitates out of the mixture, and this occurs most commonly near the intersections between the plenum 18 and the flow paths 24 in the area of the reservoirs 36. Because the reservoirs 36 are strategically situated near these locations, the fuel which precipitates out of the air-fuel mixture and liquifies is collected in the reservoirs 36. It should be noted that the reservoirs may be situated at various locations in the intake manifold.

The air-fuel mixture that flows through the passages 24 encounters the venturis 44 and flows in part through the venturis. The flow through each venturi creates a relatively low pressure on the downstream or low pressure side 48 of the venturi. The suction effect that this creates draws liquid from the reservoirs 36 through the passageways 38 and the stem passages 52 and into each venturi 42 through the port 58. The liquid fuel that is thus drawn through each port 58 is entrained in the air-fuel mixture flowing through the venturi and is finely atomized as it is entrained in the flow stream. Consequently, the air-fuel mixture that enters the intake ports 32 of the cylinders 30 contains finely atomized droplets of fuel which are well dispensed and easily vaporized in the cylinders and thus burned more completely than fuel which is less fully atomized.

The result is that the fuel is more completely burned in the combustion chambers of the cylinders, thus providing improved fuel economy, enhanced engine power, improved cold starting capabilities, quieter engine operation, spark-knock suppression, lower engine temperatures, and reduced exhaust emissions.

It should be noted that the low pressure side 48 of each venturi 42 is at a lower pressure than the opposite side 46 whenever flow is taking place through the venturi. Consequently, since the reservoirs 36 are located on the high pressure side of the venturis and the ports 58 open into the low pressure sides of the venturis, the liquid fuel is sucked from the reservoirs into the venturi even when the throttle is wide open and regardless of the pressure in the intake manifold.

Figure 4:
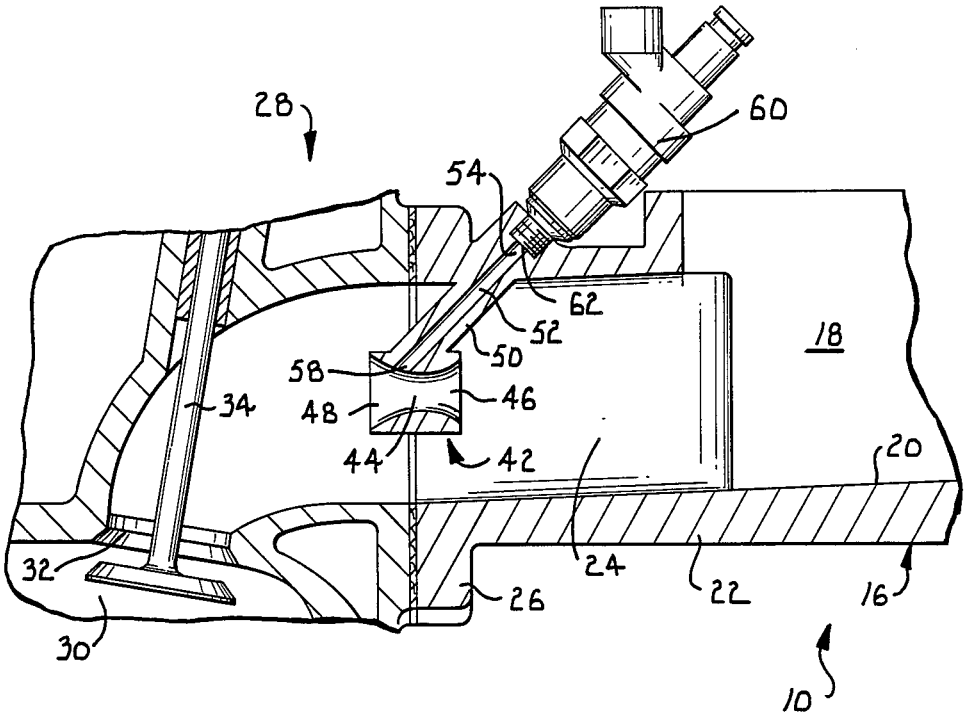
FIG. 4 is a fragmentary sectional view similar to FIG. 3 but showing a modified form of the invention constructed for use with a fuel injector.

Referring now to FIG. 4, a modified embodiment of the invention is used in engines that are equipped with fuel injectors rather than carburetors. In FIG. 4, the same numerals are used as in FIGS. 1–3 to identify the same or similar components.

In accordance with the modified form of the invention shown in FIG. 4, each manifold conduit 22 is provided with a conventional fuel injector 60 which may be threaded into the manifold conduit 22 near its downstream end. Each manifold flow passage 24 is provided near its outlet end with a venturi 42 having a restricted throat 44 and an upstream side 46 and a downstream side 48.

Each venturi is supported on the lower end of a mounting stem 50 which is identical to that shown in FIG. 3 but which extends downwardly at an angle from the top side of the manifold conduit 22. Each stem 50 has a passage 52 extending through it and having an inlet end 54 which receives fuel from the injector port 62 of the fuel injector 60. The opposite end of passage 52 terminates in a port 58 which opens into the downstream side 48 of the venturi 42.

In the fuel injected engine shown in FIG. 4, the intake manifold 10 serves simply as a device for passing air toward the cylinders 30 through the flow passages 24. The fuel injector 60 operates to inject fuel through its injector port 62 and then through passage 52 and into the downstream side 48 of venturi 42 through the port 58. The injected fuel is in liquid form and is entrained by the air which passes through the venturi 42. The airstream which passes through the venturi entrains and atomizes the fuel so that the fuel is dispersed in finely atomized droplets in the air at the time it enters the cylinder 30 through the intake port 32. Again, this fine atomization of the fuel enhances the completeness of the combustion that takes place and results in the numerous benefits that are associated with more efficient combustion. The pressure gradient in the venturi 42 assists in the fuel injecting operation because the port 58 opens into the low pressure side 48 of the venturi.

Because the presence of the venturi 42 assures that the fuel injected by the fuel injector 60 will be finely atomized, the injector port 62 of the fuel injector need not be particularly small. Accordingly, the port 62 can be larger than the hair size ports that are required in conventional fuel injectors in order to assure atomization of the fuel. Because the port 62 can be much larger than the conventional hair sized ports, the injector 60 is not nearly as susceptible to clogging of the injector port as a conventional fuel injector system.

It should also be noted that the venturi 42 is a directional device that can direct the gases flowing through it in the optimum path as they approach the intake ports 32. Consequently, by properly orienting the venturis 32, they can direct the incoming fuel mixture more toward the spark plug (not shown) than is the case in the absence of a venturi. This in turn further increases the efficiency of the combustion process.

The arrangement shown in FIG. 4 can be used in a diesel engine. In contrast to a conventional diesel engine in which the fuel is injected directly into the combustion chamber, the fuel is injected in accordance with the present invention in advance of or upstream from the intake valve. Due to the action of the venturi 42, the diesel fuel is finely atomized at the time it reaches the combustion chamber, and complete combustion is thus assured.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In an engine having a cylinder, an intake port for admitting an air-fuel mixture to the cylinder, and an intake manifold coupled with the cylinder to provide a flow passage to the intake port for the air-fuel mixture, the improvement comprising:

means for presenting a reservoir in the intake manifold for collecting liquid fuel that liquifies from the air-fuel mixture;

a venturi having a restricted throat and low and high pressure sides on opposite sides of said throat;

means for mounting said venturi in the flow passage with said low pressure side located downstream from said high pressure side; and means for providing a passage having an inlet end communicating with said reservoir to receive the liquid fuel therefrom and an outlet end opening into the low pressure side of said venturi to deliver the liquid fuel into the air-fuel mixture flowing through the venturi, thereby effecting atomization of at least some of the liquid fuel to achieve more complete combustion thereof in the cylinder.

2. The improvement of claim 1, wherein:

said intake manifold has a plenum from which the flow passage extends and a floor surface underlying the plenum; and said reservoir is located in said floor surface.

3. The improvement of claim 2, wherein said reservoir is located generally at the intersection between the flow passage and plenum.

4. The improvement of claim 2, wherein:

said intake manifold has a manifold body which presents said floor surface;

said mounting means comprises a stem extending from the manifold body and supporting said venturi thereon; and said passage extends partially in the manifold body and partially in said stem.

5. The improvement of claim 4, wherein said passage comprises:

a passageway extending in the manifold body from said reservoir; and a passage extending in said stem from said passageway and opening into said venturi on the low pressure side thereof.

6. The improvement of claim 1, wherein:

said intake manifold has a manifold body; and said mounting means comprises a stem extending from the manifold body and supporting said venturi thereof.

7. The improvement of claim 6, wherein said passage comprises:

a passageway extending in the manifold body from said reservoir; and a passage extending in said stem from said passageway and opening into said venturi on the low pressure side thereof.

8. An improved intake manifold for an engine having multiple cylinders each presenting an intake port for receiving an air-fuel mixture, said manifold comprising:

a manifold body presenting a plurality of flow passages therein for directing the air-fuel mixture to the respective intake ports for the engine cylinders, said manifold body having a plenum common to all of the flow passages and a floor surface underlying said plenum;

a venturi for each flow passage, each venturi having a restricted throat and low and high pressure sides on opposite sides of said throat;

a stem for each venturi connected with the venturi and the manifold body in a manner to mount the venturi in the corresponding flow passage with the low pressure side located downstream from the high pressure side, each stem having a passage therethrough opening into the low pressure side of the corresponding venturi;

a reservoir in said flow surface for each flow passage, said reservoirs being located to receive and collect liquid fuel that liquifies from the air-fuel mixture passing through the manifold body; and a plurality of passageways in said manifold body, each passageway leading from one of the reservoirs to the passage of the corresponding stem to provide a path for the liquid fuel to flow from the reservoirs through the passageways and stems to the low pressure sides of the venturis where the liquid fuel is atomized and entrained in the air-fuel mixture flowing through said flow passages.

9. The manifold of claim 8, wherein:

each flow passage intersects with said plenum and extends away from the plenum toward the corresponding venturi; and said reservoirs are located adjacent the intersections of the flow passages with the plenum.

10. A method of enhancing the operation of an engine having a cylinder and an intake manifold cooperating to present a flow passage for an air-fuel mixture, said method comprising the steps of:

providing in said flow passage a venturi having a high pressure side and a low pressure side located downstream from the high pressure side and separated therefrom by a restricted throat;

collecting in the intake manifold liquified fuel which liquifies from the air-fuel mixture;

directing the liquified fuel into the venturi on the low pressure side thereof to effect atomization of the liquid fuel in the low pressure side of the venturi and entrainment of the atomized fuel in the air-fuel mixture flowing through the venturi for more complete combustion of the fuel in the cylinder.

11. The method of claim 10, wherein said directing step comprises utilizing the low pressure in the low pressure side of the venturi to draw the liquified fuel into the low pressure side of the venturi.

12. An improved fuel delivery system for an internal combustion engine having a plurality of cylinders each having an intake port, said fuel delivery system comprising:

an intake manifold having a manifold body presenting a plurality of separate flow passages extending to the intake ports of the respective cylinders;

a venturi for each flow passage, each venturi having a restricted throat and low and high pressure sides on opposite sides of said throat;

means for mounting said venturis on said manifold body in the respective flow passages with said low pressure side located downstream from said high pressure side;

a fuel injector for each flow passage, each fuel injector being operable to receive liquid fuel and inject the liquid fuel for the production of a fuel-air mixture;

means for mounting the fuel injectors on the manifold body at locations to inject liquid fuel into the respective flow passages; and means for providing a passage for each fuel injector to direct the liquid fuel to the corresponding venturi, each said passage having an inlet end communicating with the corresponding fuel injector to receive the liquid fuel therefrom and an outlet end opening into said low pressure side of the corresponding venturi to delivery liquid fuel thereto for atomization of the fuel and entrainment in the air flowing through the venturi.

13. The manifold of claim 12, wherein:

said mounting means for each fuel injector comprises a stem connected with the manifold body in extension therefrom into the corresponding flow passage, said stems carrying the respective venturis thereon; and said passage for each fuel injector extends in the corresponding stem from the fuel injector to the low pressure side of the corresponding venturi.

* * * * *